United States Patent [19]

Inoue et al.

[11] Patent Number: 4,724,433

[45] Date of Patent: Feb. 9, 1988

[54] MATRIX-TYPE DISPLAY PANEL AND DRIVING METHOD THEREFOR

[75] Inventors: Hiroshi Inoue, Yokohama; Shinichi Yamashita, Kawasaki, both of Japan

[73] Assignee: Canon Kabushiki Kaisha, Tokyo, Japan

[21] Appl. No.: 796,755

[22] Filed: Nov. 12, 1985

[30] Foreign Application Priority Data

Nov. 13, 1984 [JP] Japan ..... 59-237424

[51] Int. Cl.[4] ..... G09G 3/00

[52] U.S. Cl. ..... 340/805; 340/784; 340/802

[58] Field of Search ..... 340/805, 784, 802

[56] References Cited

U.S. PATENT DOCUMENTS 4,200,868 4/1980 Lamoureux et al. ..... 340/805

4,476,466 10/1984 Mitani et al. ..... 340/805

*Primary Examiner*—Howard A. Birmiel

*Attorney, Agent, or Firm*—Fitzpatrick, Cella, Harper & Scinto

[57] ABSTRACT

A matrix-type display panel comprises a display panel having a plurality of scanning lines, a plurality of data lines and a plurality of picture elements disposed at each intersection of the scanning lines and data lines, and analog switching elements for sampling-and-holding information signals which are applied to the data lines in synchronism with scanning signals applied to the scanning lines. The matrix-type display panel is driven by a driving method comprising: applying such switching pulses to the analog switching elements that time-serial pulses among them and shifted in phase from each other and overlap each other in a same duration.

14 Claims, 10 Drawing Figures

MATRIX-TYPE DISPLAY PANEL AND DRIVING METHOD THEREFOR

FIELD OF THE INVENTION AND RELATED ART

The present invention relates to a matrix-type image display panel, particularly a high density display panel using an active matrix, and a method for driving the same using specific type of switching pulses applied to a sample-and-hold circuit.

FIGS. 1 and 2 show a conventional sample-and-hold (S/H) circuit, and the switching and clock pulses therefor, respectively. In FIG. 1, reference numeral 1 denotes a shift register for driving an analog switching element 2 such as a thin film transistor (TFT) and reference numeral 3 denotes a capacitor for holding an image signal.

Clock pulses shown in FIG. 2 are inputted to the shift register 1 and switching pulses ①-④ also shown in FIG. 2 are supplied to respective analog switching elements 2. The analog switching elements 2 are turned ON by these switching pulses, whereby information signals (image signals) are sampled-and-held in capacitors 3. As shown in FIG. 2, the conventionally used switching pulses serially applied to different analog switching elements are composed of such time-serially applied pulses or pulse trains that they are different only in phase and do not overlap each other in a same pulse duration T.

The switching pulses used in this type of driving method are required to have a frequency of $f \times n \times m$ wherein f denotes a frame frequency, n denotes the number of vertically arranged picture elements and m denotes the number of horizontally arranged picture elements, and the frequency of the clock pulses amount to twice as many as that of the switching pulses.

As a result, even when relatively few picture elements are used, e.g., $n=240$ and $m=160$, a clock pulse frequency amounts to above 4.6 MHz. Further, when the number of picture elements is increased, e.g., to $n=480$ and $m=480$, in response to the requirement for a high element density in recent years, the required frequency of clock pulses is above 27.6 MHz, so that driving with a C-MOS (complementary MOS) -type shift register as a high-speed shift register becomes impossible. As a result, there is posed a serious restraint to minimization of power consumption and cost reduction of the display apparatus.

SUMMARY OF THE INVENTION

A principal object of the present invention is, in view of the problems as mentioned above, to provide a matrix-type display panel and a driving method therefor adapted to suppress the increase in clock pulse frequency in response to an increase in the density of picture elements and allow the use of a C-MOS type shift register, so that low power consumption and cost reduction of the display apparatus are realized.

According to an aspect of the present invention, there is provided a driving method for a matrix-type display panel of the type comprising a display panel having a plurality of scanning lines, a plurality of data lines and a plurality of picture elements disposed at each intersection of the scanning lines and data lines, and analog switching elements for sampling-and-holding information signals which are applied to the data lines in synchronism with scanning signals applied to the scanning lines; the driving method comprising: applying such switching pulses to the analog switching elements that time-serial pulses among them are shifted in phase from each other and overlap each other in the same duration.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

A sample-and-hold circuit is operated for storing and transferring image-signals supplied to horizontally arranged picture elements of an active matrix-type image display apparatus based on controlling signals from a shift register. According to the present invention, switching pulses supplied time-serially from a shift register to analog switching elements of a sample-and-hold circuit are caused to shift by an arbitrary amount of difference (e.g., 45°, 90°, etc.) with each other and overlap each other in a same period or duration, whereby an available periods for changing the sample-and-hold circuit are increased.

Figure 1:
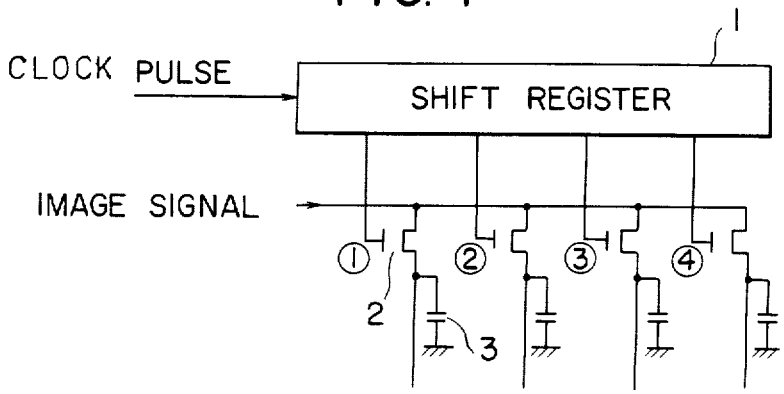
FIG. 1 is a diagram of a conventional sample-and-hold circuit.
Figure 2:
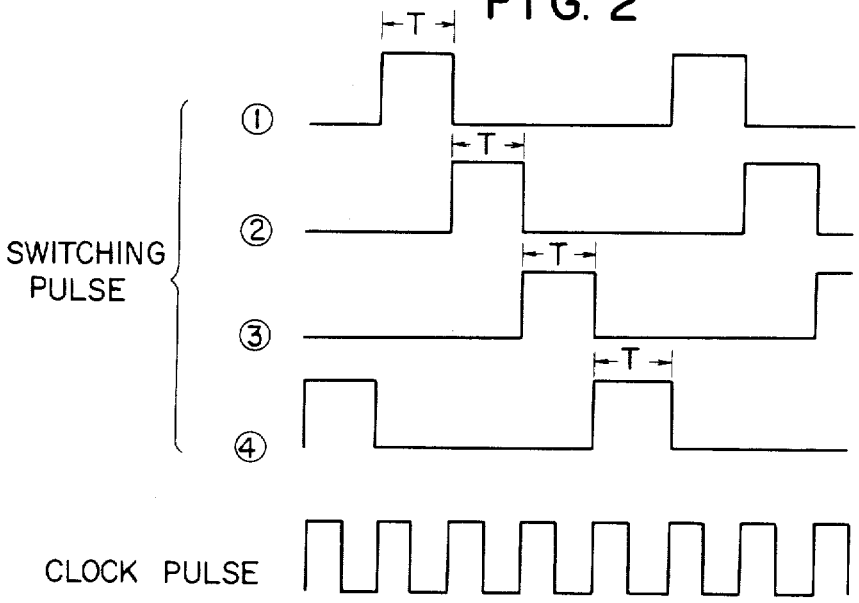
FIG. 2 shows timing clock pulses and switching pulses applied to the shift register shown in FIG. 1.
Figure 3A:
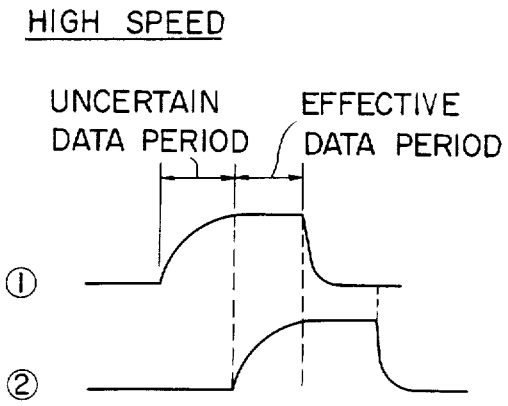
FIGS. 3A and 3B show waveforms of switching pulses applied according to the invention.
Figure 3B:
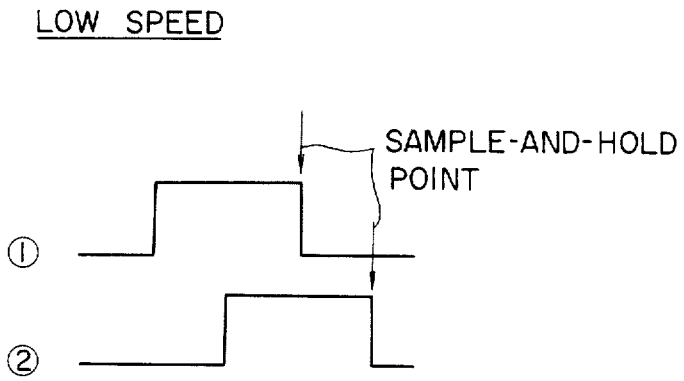

FIGS. 3A and 3B show states where the above mentioned pulses are supplied to analog switching elements of a sample-and-hold circuit. FIGS. 3A and 3B show cases where time-serially supplied pulses shift in phase by 90° with each other and overlap each other in a same cycle or duration. Similar image data are applied to respective analog switching elements concerned during the overlapped period. However, when the pulses are of high speed as shown in FIG. 3A, an effective data period is attained in the latter period of the pulse because of its large rise time, so that the image data during a former overlapping half period of the pulse does not have a substantial effect. Furthermore, even when the pulses are of a relatively low speed and the rise time is a small percentage of a whole pulse duration (i.e., when the time constant for charging the a switching element is sufficiently smaller than the pulse duration) as shown in FIG. 3B, image data held in sample-and-hold capacitors are mainly determined by the time of the falling points of the waveforms so that the image data applied during the overlapping period do not substantially exert any ill effects.

Figure 4:
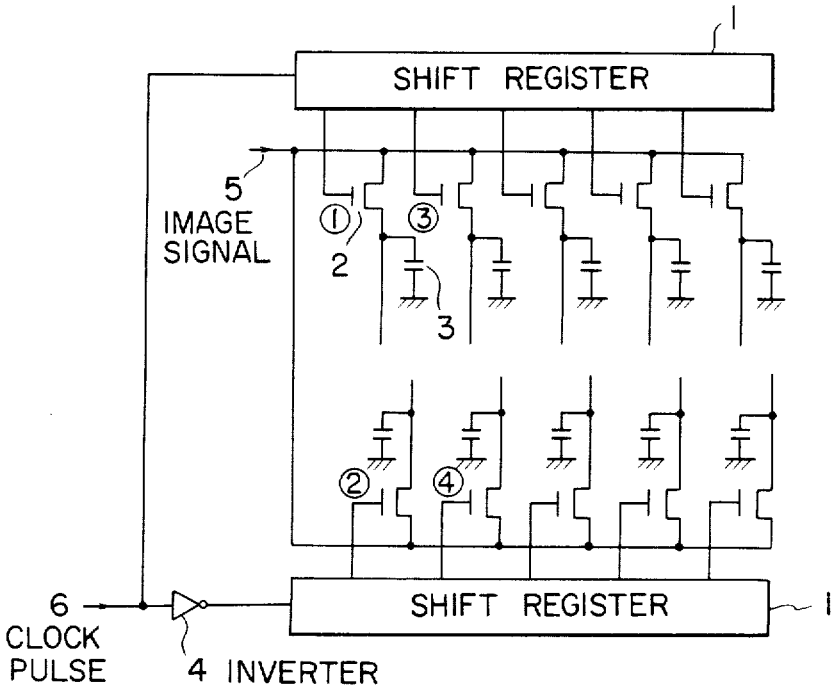
FIG. 4 is a circuit diagram according to a first embodiment of the invention.
Figure 5:
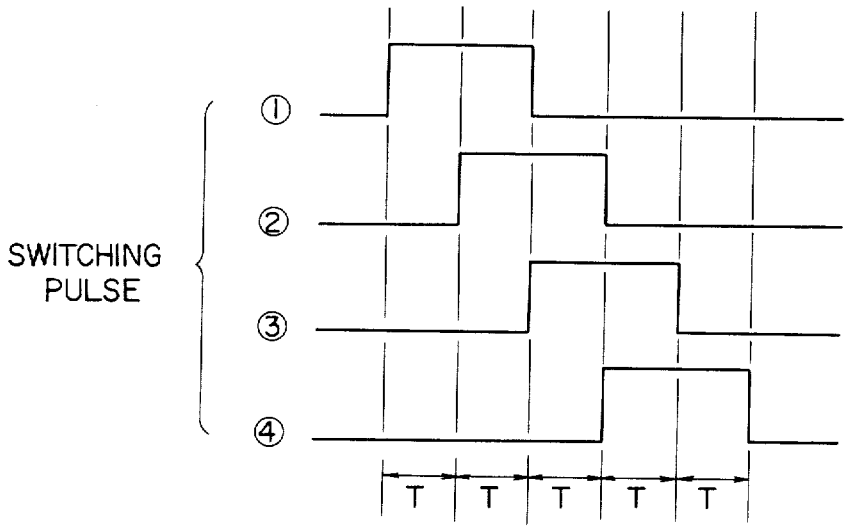
FIG. 5 shows waveforms of switching pulses applied in the first embodiment.

A first embodiment of the driving method according to the present invention is explained with reference to FIG. 4 showing a circuit diagram used in the first embodiment and FIG. 5 showing switching pulses supplied from a shift register. Referring to FIG. 4, a shift register generates switching pulses corresponding to input clock pulses. The switching pulses are applied to analog switching elements 2, e.g., comprising thin film transistors, and the information signals 5 are sampled-and-held in capacitors 3. An inverter 4 is used to reverse the clock pulses applied to a lower shift register 1.

In this circuit, two shift registers 1 are disposed at an upper position and a lower position, and the controlling signal lines leading to the analog switching elements are alternately connected to these upper and lower shift registers. Thus, signal lines are distributed into halves and respectively connected to the two shift registers.

When the upper and lower shift registers 1 are driven by two sets of clock pulses with mutually inverted phases by using the above mentioned circuit arrangement, switching pulses supplied to the analog switching elements 2 are shown at ①-④ in FIG. 5. Thus, FIG. 5 shows that time-serially supplied pulses are shifted from each other by a phase difference of 90° and overlap each other in a same pulse period or duration 2T.

In the above embodiment, the frequency of the clock pulses becomes one half of clock pulses conventionally used and is reduced to 13.8 MHz for 480×480 picture elements, while the switching pulse frequency is reduced to 6.9 MHz.

Figure 6:
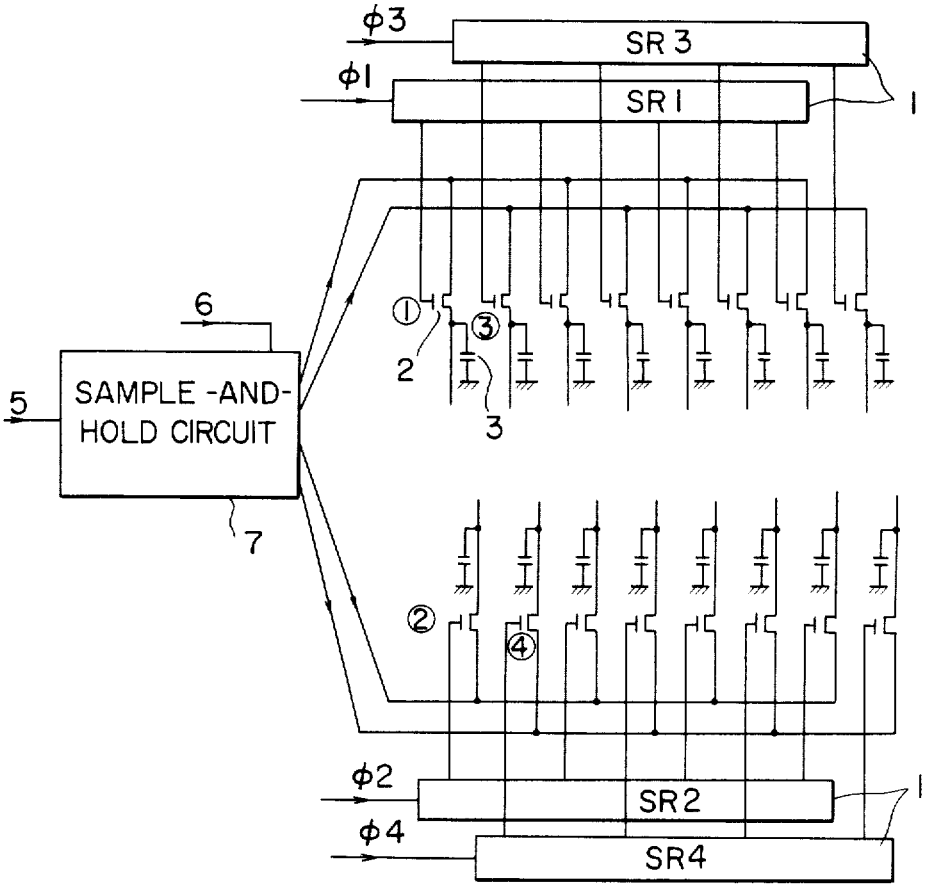
FIG. 6 is a circuit diagram according to a second embodiment of the invention.
Figure 7A:
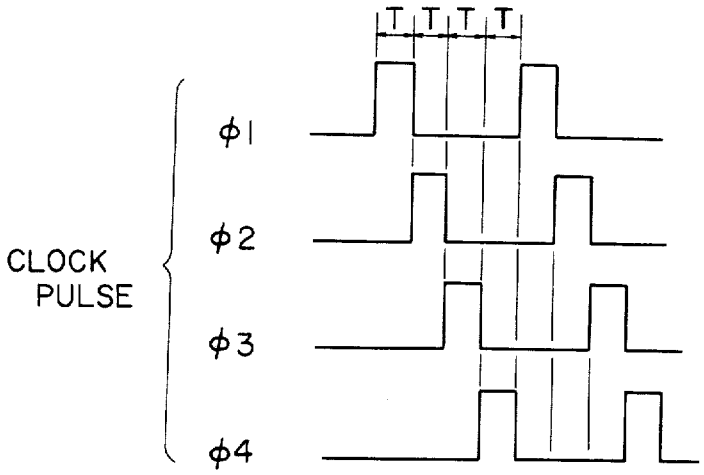
FIG. 7A shows waveforms of timing clock pulses applied to respective shift registers and FIG. 7B shows waveforms of switching pulses supplied from respective shift registers, respectively used in the second embodiment.
Figure 7B:
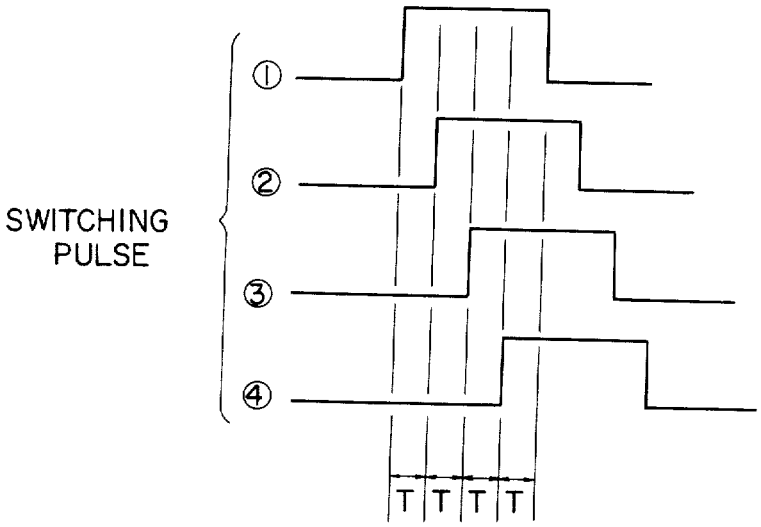

A second embodiment of the present invention is shown with reference to FIG. 6 showing a circuit diagram used in the second embodiment. FIG. 7A shows timing clock pulses applied to respective shift registers 1 and FIG. 7B shows switching pulses supplied from the shift registers 1.

In this embodiment, two shift registers each are disposed at upper positions and lower positions, respectively, and the controlling signal lines leading to the analog switching elements 2 are distributed row by row upwardly and downwardly. Further, the upwardly distributed or directed controlling signal lines are further connected alternately to a pair of upper shift registers $SR_1$ and $SR_3$, while the downwardly distributed controlling signal lines are connected alternately to a pair of lower shift registers $SR_2$ and $SR_4$.

According to the circuit arrangement shown in FIG. 6, image signals 5 are sampled-and-held by a sample-and-hold circuit 7 to be distributed in accordance with timing clock pulses to the shift registers, which correspond to the phase differences of the switching pulses.

In the above embodiment, timing clock pulses as shown at $\phi_1$-$\phi_4$ in FIG. 7A, which are 25% duty clock pulses with phases differing by 90° each, are applied to respective shift registers. When such clock pulses are applied, switching pulses as shown at ①-④ in FIG. 7B are applied to analog switching elements 2. FIG. 7B shows that time-serially supplied pulses are shifted from each other by 45° and overlap each other in a same pulse duration 4T. When the pulses shown at ①-④ in FIG. 7B are considered, a pulse having a duration of 4T is applied to a switching element, and adjacent or time serially supplied pulses overlap each other for a period of 3T (¾ of a pulse duration). However, the overlapping has no substantial effect on image data supplied to sample-and-hold capacitors 3 as explained hereinbefore.

In the above embodiment, the frequency of the clock pulses becomes one fourth of that conventionally used and is reduced to 6.9 MHz for 480×480 picture elements.

In the above circuit structure, as 25% duty clock pulses with phases differing by 90° each are required, a means for generating and distributing the clock pulses, e.g., constituted by a high-speed IC such as a high-speed clock-operated 4 bit-shift register) is additionally required. However, such an additional means constitutes only a minor part of the whole system, e.g., such a clock pulse distributing means requires 4 bits whereas each shift register is one with 120 bits (=480/4 bits). therefore, it has a minor effect on power consumption and a system cost, when compared to the great advantages accompanying the use of low-speed C-MOS shift registers and switching elements.

Figure 8:
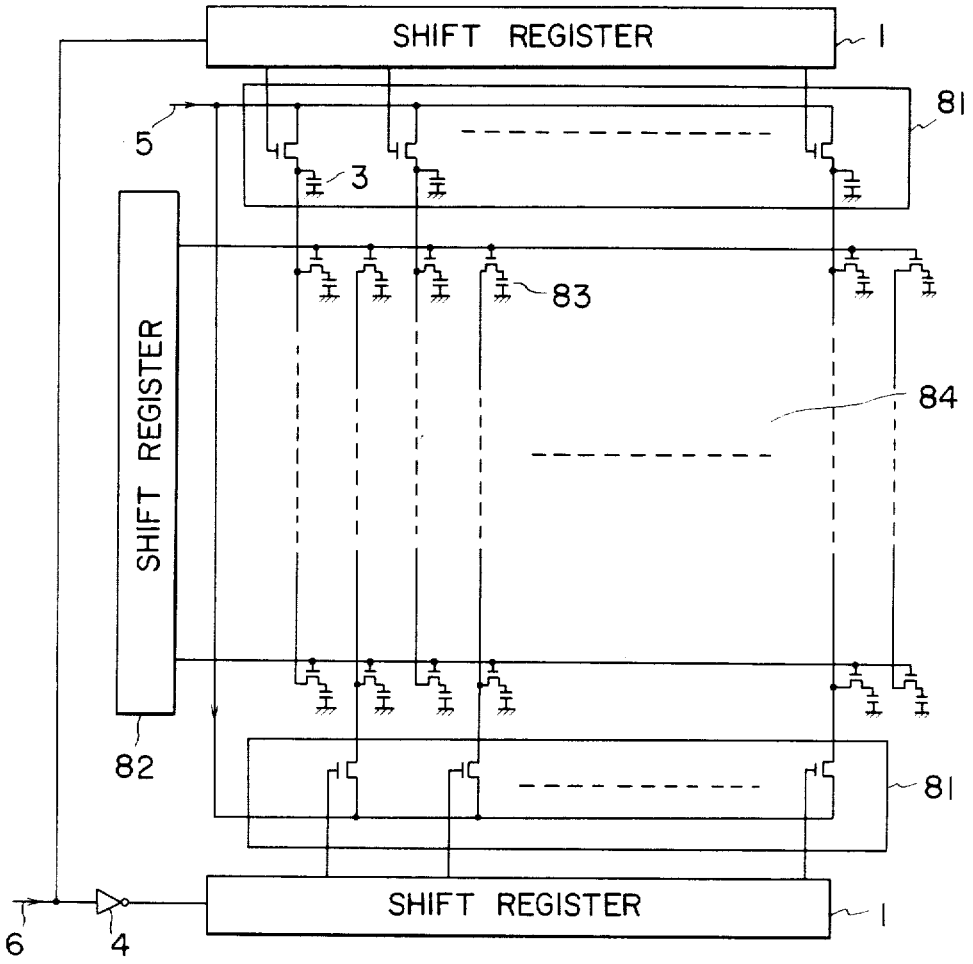
FIG. 8 is a circuit diagram illustrating an active matrix-type display panel according to the invention.

FIG. 8 shows a circuit diagram of an active matrix-type display panel, wherein reference numeral 81 inclusively denotes analog switching elements as described above connected to sample-holding condensers 3; 82 denotes a shift register for generating scanning signals; 83 denotes capacitive components provided by, e.g., a nematic liquid crystal; and 84 denotes an n×m matrix display panel.

As described above, according to the invention switching pulses, time-serially or successively supplied to analog switching elements constituting a sample-and-hold circuit, are shifted in phase from each other and overlap each other in a same period or duration. As a result of this structure, even though an increase in the frequency of clock pulses accompanies an the increase in element density, the high-speed shift registers can be constituted by C-MOS, and therefore, a display apparatus can be driven at a low power consumption and produced at a low cost.

Further, according to a second embodiment, the charging time (sampling time) for a switching element is increased to 4 times as long as that conventionally used, so that charge efficiency is improved thereby resulting in the advantage that a high-speed analog switching element conventionally used is unnecessary.

What is claimed is:

1. A driving method for a matrix-type display panel of the type comprising a display panel having a plurality of scanning lines, a plurality of data lines and a plurality of picture elements disposed at each intersection of the scanning lines and data lines, and analog switching elements for sampling-and-holding information signals which are applied to the data lines in synchronism with scanning signals applied to the scanning lines, wherein said analog switching elements are divided into first and second groups of analog switching elements which are connected to a first shift register and a second shift register respectively, said driving method comprising the step of:

successively applying switching pulses to said analog switching elements so that a pair of switching pulses successively applied to an analog switching element in said first group and an analog switching element in said second group, respectively, are sequenced so that said pair of switching pulses at least partially overlap each other in time.

2. The driving method according to claim 1, wherein said switching pulses are supplied from a shift register constituted by C-MOS.

3. The driving method according to claim 1, wherein said analog switching element is constituted by a thin film transistor connected with a sample-holding capacitor.

4. The driving method according to claim 1, wherein said time-serially applied switching pulses have a phase difference of 90° from each other.

5. The driving method according to claim 1, wherein said time-serially applied switching pulses have a phase difference of 45° from each other.

6. The driving method according to claim 1, wherein said information signals are image signals.

7. The driving method according to claim 1, wherein said display panel is an active matrix-type display panel.

8. The driving method according to claim 1, wherein said data lines comprise even and odd numbered data lines, wherein said first group of analog switching elements are each connected to an odd-numbered data line, and said second group of analog switching elements are each connected to an even-numbered data line.

9. The driving method according to claim 1, wherein said first group of analog switching elements includes a sub-group of analog switching elements connected to 1st, 5th, 9th, . . . and (4n−3)th data lines, respectively, and a sub-group of analog switching elements connected to 2nd, 6th, 10th, . . . and (4n−2)th data lines, and wherein said second group of analog switching elements includes a sub-group of analog switching elements connected to 3rd, 7th, 11th, . . . and (4n−1)th data lines, and a sub-group of analog switching elements connected to 4th, 8th, 12th, . . . and (4n)th data lines, wherein n is an integer.

10. A matrix-type display panel, comprising:

a display panel having a plurality of scanning lines, a plurality of data lines divided into a first group and a second group, and a plurality of picture elements disposed at each intersection of the scanning lines and the data lines;

a first group of analog switching elements each connected to one of the first group of data lines, and a second group of analog switching elements each connected to one of the second group of data lines;

a first group of sample-and-hold capacitors each connected to one of the first group of analog switching elements, and a second group of sample-and-hold capacitors each connected to one of the second group of analog switching elements;

a first shift register connected to and supplying switching pulses to said first group of analog switching elements, and a second shift register connected to and supplying switching pulses to said second group of analog switching elements; and means for providing a pair of successively applied switching pulses from said first and second shift registers, respectively, such that said pair of successively applied switching pulses at least partially overlap in time.

11. The matrix-type display panel according to claim 10, wherein said shift register is constituted by C-MOS.

12. The matrix-type display panel according to claim 10, wherein said analog switching elements are constituted by thin film transistors.

13. The matrix-type display panel according to claim 10, wherein said first shift register includes a shift register connected to 1st, 5th, 9th, . . . and (4n−3)th data lines and a shift register connected to 2nd, 6th, 10th, . . . and (4n−2)th data lines, and wherein said second shift register includes a shift register connected to 3rd, 7th, 11th, . . . and (4n−1)th data lines, and a shift register connected to 4th, 8th 12th . . . and (4n)th data lines, wherein n is an integer.

14. The matrix-type display panel according to claim 10, wherein said first shift register is associated with odd-numbered data lines and said second shift register is associated with even-numbered data lines.

* * * * *

UNITED STATES PATENT AND TRADEMARK OFFICE

CERTIFICATE OF CORRECTION

PATENT NO. : 4,724,433

DATED : February 9, 1988

INVENTOR(S) : H. INOUE, ET AL.

It is certified that error appears in the above-identified patent and that said Letters Patent is hereby corrected as shown below:

AT [57] IN THE ABSTRACT

Line 11, "and" should read --are--.

COLUMN 2

Line 43, "an" should read --the--;
Line 46, "above men-" should read --above-men- --.
Line 62, "the" should read --of--.

COLUMN 3

Line 20, "above mentioned"
should read --above-mentioned--.
Line 62, "time" should read --time- --.
Line 68, "one fourth" should read --one-fourth--.

UNITED STATES PATENT AND TRADEMARK OFFICE

CERTIFICATE OF CORRECTION

PATENT NO. : 4,724,433

DATED : February 9, 1988

INVENTOR(S) : H. INOUE, ET AL.

It is certified that error appears in the above-identified patent and that said Letters Patent is hereby corrected as shown below:

COLUMN 4

Line 7, "4-bit shift register)" should read --4-bit shift register,--.
Line 11, "there-" should read --There- --.
Line 30, "the" should be deleted.
Line 35, "a" should read --the--; and "the" should read --a--.

COLUMN 5

Line 12, "even and odd numbered" should read --even- and odd-numbered--.

Signed and Sealed this

Fifth Day of July, 1988

*Attest:*

*Attesting Officer*

DONALD J. QUIGG

*Commissioner of Patents and Trademarks*